US005402625A

United States Patent [19]

Halstead

[11] Patent Number: 5,402,625

[45] Date of Patent: Apr. 4, 1995

[54] BAG LOADER FOR BONE-IN PRODUCTS

[75] Inventor: Clifford S. Halstead, Spartanburg, S.C.

[73] Assignee: W. R. Grace & Co.-Conn., Duncan, S.C.

[21] Appl. No.: 57,610

[22] Filed: May 4, 1993

[51] Int. Cl.[6] ..... B65B 43/26

[52] U.S. Cl. ..... 53/570; 53/258; 53/572

[58] Field of Search ..... 53/570, 571, 572, 574, 53/575, 258

[56] References Cited

U.S. PATENT DOCUMENTS

| | | | |
|---|---|---|---|
| 2,770,084 | 11/1956 | Ruderman | 53/572 |
| 2,885,850 | 5/1959 | Smith | 53/258 |
| 2,946,166 | 7/1960 | Baxter | 53/258 |
| 3,774,367 | 11/1973 | Lerner | 53/570 |
| 3,935,691 | 2/1976 | Broch | 53/572 |
| 3,945,171 | 3/1976 | Marietta, Jr. et al. | 53/258 |
| 4,028,775 | 6/1977 | Tysver | 53/258 |
| 4,062,169 | 12/1977 | Lister et al. | 53/258 |
| 4,147,012 | 4/1979 | van Mil | 53/572 |

*Primary Examiner*—W. Donald Bray
*Attorney, Agent, or Firm*—William D. Lee, Jr.; Mark B. Quatt; Rupert B. Hurley, Jr.

[57] ABSTRACT

The invention relates to an apparatus and method for loading bone-in meat products into flexible receptacles such as thermoplastic bags. The apparatus comprises a bag loading table having a hopper and bag holder comprising metal rods such that the bone-in product does not contact the bag during loading and thereby eliminates bag failure caused by bone damage.

13 Claims, 3 Drawing Sheets

BAG LOADER FOR BONE-IN PRODUCTS

BACKGROUND OF THE INVENTION

1. Field of the Invention

This invention relates to an apparatus for automatically loading bone-in products into containers. The invention particularly relates to the loading of articles such as bone-in whole pork loins into flexible containers such as thermoplastic bags or pouches.

2. Description of the Related Art

In packaging machines, it is known to provide bag loading devices which take an empty bag and hold the bag open while a product is inserted into the bag. It is normal for the article to be inserted into the bag by a mechanically actuated pusher which reciprocates between a first, retracted position in which an article can be introduced into the space between the pusher and the bag loading table, and a second, extended position in which the pusher has advanced such an article onto the loading table and into the open bag.

As used herein, the term "bag" is intended to denote any open-ended flexible container of bag-like construction, and is not intended to limit the invention to any particular type of bag-like container. The invention is, for example, equally applicable to gusseted bags as to non-gusseted bags. The bags used with the device may for example be multi-layer bags having at least one layer to impart mechanical strength to the bag, and/or at least one layer to impart sealability by thermal welding, and/or at least one gas-impervious barrier layer.

Once the bag has been loaded in this way, the bag is conventionally advanced either by means of an extended movement of the pusher itself, or by alternative conveying means, to a subsequent sealing station. One example of such a system is shown in British Patent GB 2074972 B issued Oct. 5, 1983 to Nino Imperiale, where a pair of flat metal spreaders, located on opposite sides of a bag hold the bag open for insertion of a block shaped article into the bag. This bag loader does not support the total circumference of the bag, nor does the flat metal spreaders extend the full length of the bag. Another example of a conventional bag loader is disclosed in British Patent Specification No. 1516498 where the interior of the bag is subjected to atmospheric conditioning in the form of evacuation through a hollow pusher. Yet another example of a conventional bag loader is disclosed in U.S. Pat. No. 4,015,402 issued Apr. 5, 1977 to Domnitz et al. This reference discloses a bag loader for loading heavy block items such as blocks of cheese weighing 40 pounds or more into flexible bags utilizing a stream of air to hold the bag mouth open and spreader members of solid sheet stainless steel. The spreader members extend into the bag only far enough to prevent the cheese from contacting the bag sides at the sealing point.

Such bag loaders prepare the bag for use with a clipping, tying or heat sealing closing operation, but is not capable of protecting the flexible film bag from tearing caused by the bone ends along the full length of the bag during the loading operation.

OBJECTS AND SUMMARY OF THE INVENTION

One object of the present invention is to provide an means of packaging a bone-in product in a heat shrinkable flexible film.

Another object of the present invention is to provide a means of protecting a heat shrinkable flexible film bag from tears and punctures by bone-in products during the packaging process.

Yet another object of the present invention is to provide a packaging device for bone-in products which may be used in conjunction with present gas flushing, and bag sealing equipment.

A further object is to provide a flexible film bag packaging apparatus which is easier and faster to operate while reducing the failure rate of the flexible film bags.

Accordingly, one form of the present invention relates to a bag loading apparatus comprising means for holding an open bag ready to receive a product article therein; a retractable pusher driven for movement back and forth along a path between (a) a first position in which it is retracted behind a hopper and able to receive a product article between its said first position and the open mouth of a bag held by a bag holding means and (b) a second position in which second position said retractable pusher will have displaced a suitable product article into an open bag on the bag holding means; the improvement comprising said bag holding means comprising metal rods positioned to protect substantially all of the open bag from contact with and damage from the product article displaced therein.

Another form of the present invention relates to a package formed using the bag loading apparatus of described hereinabove.

Preferred forms of the invention, as well as other embodiments, objects, features and advantages of this invention, will be apparent from the following detailed description which is to be read in connection with the accompanying drawings.

BRIEF DESCRIPTION OF THE DRAWINGS

In the drawings which are appended hereto and make a part of this disclosure.

DESCRIPTION OF THE PREFERRED EMBODIMENTS OF THE INVENTION

Figure 1:
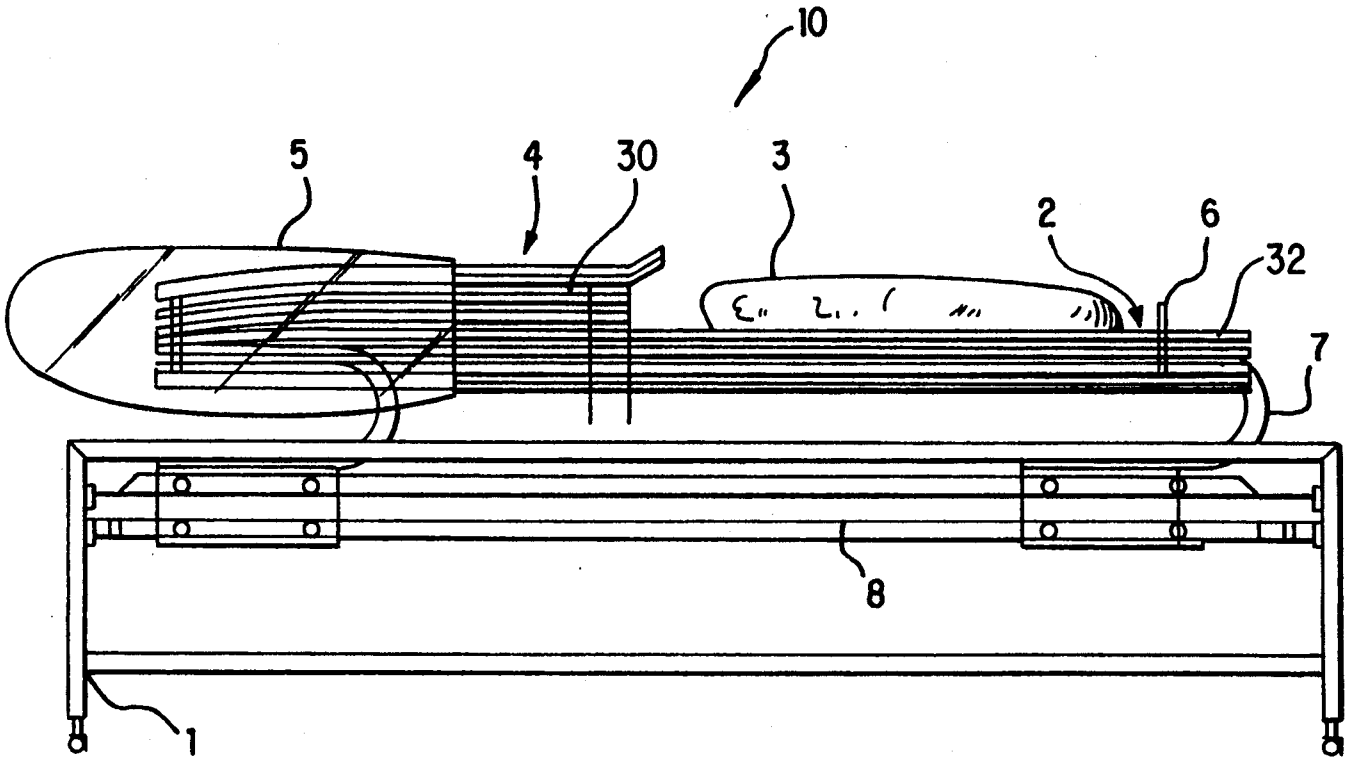
FIG. 1 shows a plan view of an apparatus of the present invention.

The present invention will be better understood from the specification taken in conjunction with the accompanying drawings in which like reference numerals refer to like parts.

With such a device, the loading bag can be heat sealed with or without atmospheric conditioning either on a bag loading table or just beyond the end of a bag loading table, the movement of the bag to the sealing and/or atmospheric conditioning station being preferably achieved by means of the pusher member of the bag loader.

Preferably the atmospheric conditioning is evacuation, and the atmospheric conditioning nozzle comprises a nozzle communicated to a source of vacuum. Alternatively, the atmospheric conditioning may be gas flushing, and the nozzle may be communicated with a source of flushing gas. A combination of gas flushing and at least partial evacuation of the bag interior may be employed, if desired.

Means may be provided for adjusting the stroke of the pusher member so that the pusher member always displaces the product article to the closed end of a bag at the loading station, thereby allowing the device to be adjusted to accommodate different bag lengths and product article dimensions.

The supply of bags to the bag loading station may be by any conventional form, for example, a chain of imbricated taped bags or a stack of wicketted bags. Bag opening may be automatically performed by inflation air jets, or the bags may be individually placed on the bag holding members.

The switches and air control valves referred to hereinabove are familiar to those skilled in the art and are generally solenoid actuated valves. However, the pneumatic cylinders referred to could be replaced with electrical drives such as electrical motors and heavy duty solenoids and all the switching could be electrical; but, compressed air driven pneumatic cylinders controlled by an electrical programmable controller are preferred for the subject apparatus.

Also, while the subject invention contemplates primarily the loading of bone-in meat articles, block-like articles as well as articles of right circular cylinder shape or other shape could be loaded.

Figure 2:
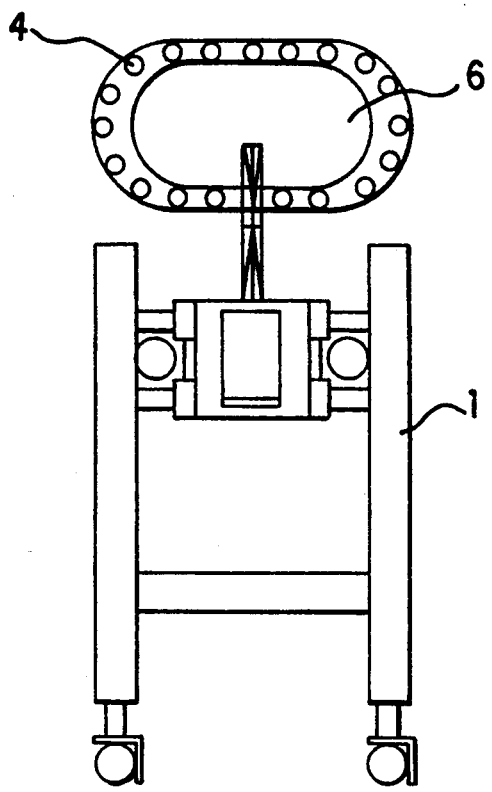
FIG. 2 shows an end view of the apparatus of FIG. 1
Figure 3:
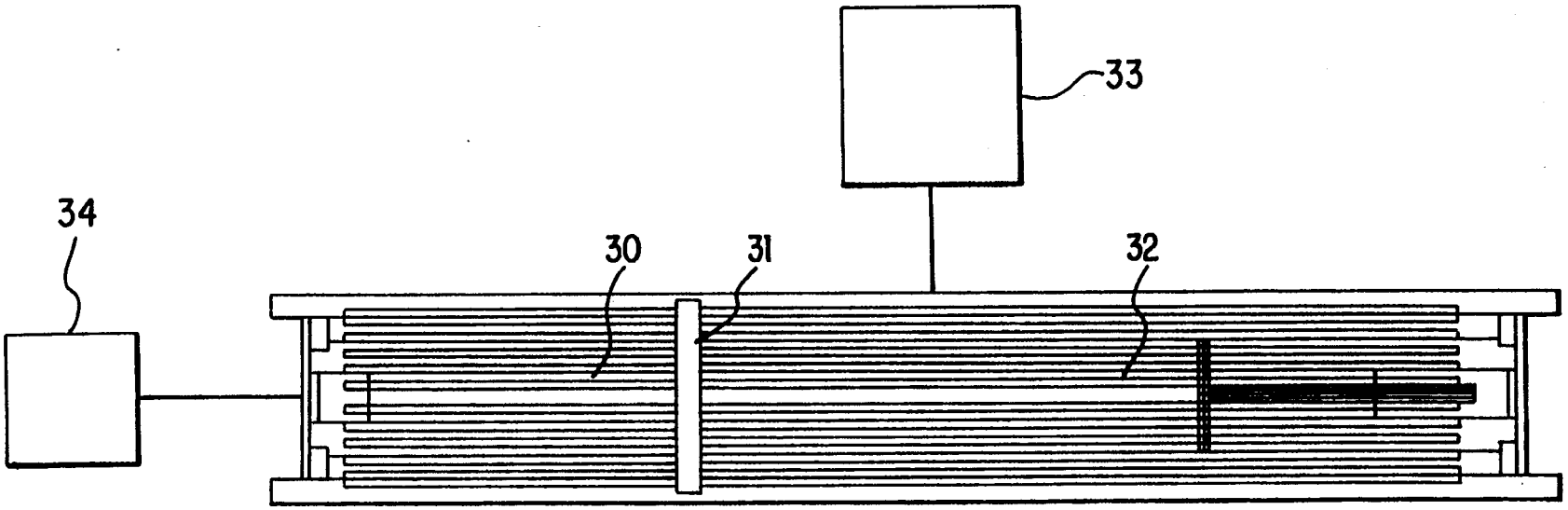
FIG. 3 shows a top view of the hopper and bag holding portions of the apparatus shown in FIG. 1.

Turning now to the figures, FIG. 1 shows a front view of a preferred embodiment of the present invention 10 wherein a bag loading table 1 has a hopper 2 comprised of metal rods, for introducing a bone-in product 3 for packaging, a bag holder 4 comprised of metal rods, in line with said hopper 2 and having a proximal open end in communication with hopper 2 and a distal open end from said hopper 2 for locating and holding the mouth of bag 5 open at a position over said bag holder 4, and a retractable pusher 6. Also shown is a moving means 8 for moving retractable pusher 6 via retractable pusher carriage 7 along the grain of the bag loading table 1 and thereby moving the bone-in product from the hopper 2 into the bag holder 4 and bag 5. It should be noted that the preferred bag holder 4 is configured to taper to a slightly reduced diameter at the bag 5 loading end to facilitate loading bag 5 onto bag holder 4. FIG. 2 shows an end view of loading table 1 showing the positioning of the retractable pusher 6 in relation to the bag holder 4. As is shown the retractable pusher 6 moves along the length of the hopper 2 and the bag holder 4 at a position above the rods 30 and 32 (FIG. 3). FIG. 3 shows a top view of the bag holder 4 comprising metal rods 30 and bag holder end portion 31 in conjunction with hopper 2 comprising metal rods 32. The metal rods 30 forming the bag holder may be separate and distinct from the rods forming the hopper 9. Preferably, the rods 32 forming the hopper 2 extend to also form the bottom metal rods of bag holder 4. It is to be understood that hopper 2 may be constructed from sheet metal or other solid sheet material with a opening which allows retractable pusher 6 to move the length of the bag loading table 10. While FIG. 3 shows the bag holder 4 having a general shape corresponding to a flattened ellipse, any desired shape may be utilized which allows the efficient loading of the bone-in product 3 into the bag 5.

In practice a bone-in product 3 is placed in hopper 2 between the proximal open end to the bag holder 4 and the retractable pusher 6. The retractable pusher 6 is then moved toward the bag holder 4 via retractable pusher carriage 7 and moving means 8, pushing the bone-in product 3 into bag holder 4 and bag 5 previously loaded on bag holder 4. Retractable pusher 6 has an adjustable travel distance controlled by a control mechanism (not shown) such that the bone-in product 3 may be positioned in bag 5 at a desired location and such that each bone-in product 3 is positioned within bag 5 at the same position. The retractable pusher 6 is then drawn out of the bag 5 and the bag holder 4 via retractable pusher carriage 7 and moving means 8. It is to be understood that the bone-in product 3 and the bag 5 may be manually or automatically introduced into the above process as is desired by, and well known to those skilled in this art. Means for automatically introducing bone-in product 3 is represented schematically in FIG. 3 as box 33. Means for automatically introducing bag 5 onto bag holder end portion 31 is represented schematically in FIG. 3 as box 34. It is further understood that the bag 5 containing bone-in product 3 is removed from the bag loading table 10 for sealing and further processing if necessary using methods and apparatus well known to those skilled in this art. As can be appreciated substantially all of the bag is protected from damage by the bone-in product during its being loaded into said bag. This substantially, eliminates one of the major packaging failure problems in this type of product packaging.

Although the illustrative embodiments of the present invention have been described herein with reference to the accompanying drawings it is to be understood that the invention is not limited to those precise embodiments, and that various other changes and modifications may be effected therein by one skilled in the art without departing from the scope or spirit of the invention.

What is claimed is:

1. A bag loading apparatus comprising:

means for holding an open bag ready to receive a product article therein;

a retractable pusher driven for movement back and forth along a path between:

(a) a first position in which the pusher is retracted behind a hopper and able to receive a product article between its said first position and the open mouth of a bag held by a means for holding the bag; and (b) a second position in which second position said retractable pusher will have displaced a suitable product article into an open bag on the means for holding the bag;

said means for holding the bag comprising metal rods positioned to protect substantially all of the open bag from contact with and damage from the product article displaced therein.

2. A bag loading apparatus as claimed in claim 1 wherein, said product article is a bone-in meat product.

3. A bag loading apparatus as claimed in claim 1 wherein, said product article is a bone-in pork loin product.

4. A bag loading apparatus as claimed in claim 1 wherein, said hopper is formed of metal rods.

5. A bag loading apparatus as claimed in claim 1 wherein, said metal rods of the bag holding means are separate from the hopper forming rods.

6. A bag loading apparatus as claimed in claim 1 wherein, said metal rods of the hopper also comprise the bottom portion rods of the bag holding means.

7. A bag loading apparatus as claimed in claim 1 wherein, said product article is manually introduced into the hopper.

8. A bag loading apparatus as claimed in claim 1, further comprising means for automatically introducing said product article into the hopper.

9. A bag loading apparatus as claimed in claim 1 wherein, said bag is introduced onto the bag holding means manually.

10. A bag loading apparatus as claimed in claim 1, further comprising means for automatically introducing said bag into the means for holding the bag.

11. A package formed using the bag loading apparatus of claim 1.

12. The bag loading apparatus according to claim 1, wherein the rods are spaced apart.

13. A bag loading apparatus comprising a bag holder comprising a plurality of spaced-apart rods, a hopper comprising a plurality of spaced-apart rods, and a reciprocatable product pusher.

* * * * *